US010668343B2

(12) United States Patent
Park

(10) Patent No.: US 10,668,343 B2
(45) Date of Patent: Jun. 2, 2020

(54) METHOD AND APPARATUS FOR PLAYING TEAM GOLF

(71) Applicant: Smart Body LLC, West Warwick, RI (US)

(72) Inventor: Young Sung Park, Warwick, RI (US)

(73) Assignee: Smart Body LLC, West Warwick, RI (US)

( * ) Notice: Subject to any disclaimer, the term of this patent is extended or adjusted under 35 U.S.C. 154(b) by 0 days.

(21) Appl. No.: 16/372,074

(22) Filed: Apr. 1, 2019

(65) Prior Publication Data

US 2019/0224546 A1 Jul. 25, 2019

Related U.S. Application Data

(63) Continuation-in-part of application No. 14/659,868, filed on Mar. 17, 2015, now abandoned.

(60) Provisional application No. 61/967,725, filed on Mar. 25, 2014.

(51) Int. Cl.

| | |
|---|---|
| ***A63B 67/02*** | (2006.01) |
| ***A63B 57/10*** | (2015.01) |
| *A63B 102/32* | (2015.01) |
| *A63B 71/06* | (2006.01) |

(52) U.S. Cl.

CPC ..... *A63B 67/02* (2013.01); *A63B 57/10* (2015.10); *A63B 2071/0694* (2013.01); *A63B 2102/32* (2015.10); *A63B 2208/12* (2013.01)

(58) Field of Classification Search

CPC ..... A63B 67/02; A63B 57/10; A63B 2208/12; A63B 2071/0694; A63B 2102/32; A63B 53/00

USPC ..... D21/717; 473/409

See application file for complete search history.

(56) References Cited

U.S. PATENT DOCUMENTS

| | | | | | |
|---|---|---|---|---|---|
| 2,033,269 | A * | 3/1936 | Williams | ..... | A63B 57/10 473/257 |
| 3,161,411 | A * | 12/1964 | Cockburn | ..... | A63B 57/10 473/279 |
| 3,288,470 | A * | 11/1966 | Post | ..... | A63B 57/10 473/278 |
| 3,473,812 | A * | 10/1969 | Pelzmann | ..... | A63B 57/10 473/278 |

(Continued)

FOREIGN PATENT DOCUMENTS

| | | | | | |
|---|---|---|---|---|---|
| CA | 2160932 | A1 * | 4/1997 | ..... | A63B 57/10 |
| EP | 0270696 | A1 | 6/1988 | | |

(Continued)

OTHER PUBLICATIONS

"Tournament Formats/Side Games—Alternate Shot," Golf Course Gurus, retrieved Jun. 28, 2016. http://www.golfcoursegurus.com/tournament/.

(Continued)

*Primary Examiner* — Steven B Wong

(74) *Attorney, Agent, or Firm* — Foley Hoag LLP; Rajesh Vallabh

(57) ABSTRACT

A method is disclosed for collaboratively playing golf in an optional selective shot format by a group of golf players on a golf course using a single set of golf clubs and a single golf ball. Players use a novel golf tee configured particularly for team golf to inhibit side spin of the golf ball upon impact by the golf club.

14 Claims, 8 Drawing Sheets

(56) References Cited

U.S. PATENT DOCUMENTS

| | | | | | |
|---|---|---|---|---|---|
| 3,506,263 | A * | 4/1970 | Arrington | A63B 57/13 | 473/278 |
| 3,749,409 | A * | 7/1973 | Redmon | A63B 57/10 | 473/261 |
| 4,367,879 | A * | 1/1983 | Messer | A63B 57/10 | 473/278 |
| 5,193,803 | A * | 3/1993 | Flick, III | A63B 57/10 | 473/392 |
| D352,080 | S * | 11/1994 | Boyer | D21/717 | |
| 5,413,348 | A | 5/1995 | Basso | | |
| 5,523,737 | A | 6/1996 | Luna | | |
| 5,984,808 | A * | 11/1999 | Fleischer | A63B 57/10 | 473/388 |
| 6,344,003 | B1 * | 2/2002 | Choung | A63B 57/10 | 473/387 |
| 6,955,611 | B2 | 10/2005 | Kimmel | | |
| 7,384,342 | B2 | 6/2008 | Brennan | | |
| 7,402,115 | B2 | 7/2008 | Moussa | | |
| 8,758,170 | B2 | 6/2014 | Reeves | | |
| 2001/0029212 | A1 * | 10/2001 | Dovigi | A63B 57/10 | 473/387 |
| 2006/0287135 | A1 * | 12/2006 | Pommereau | A63B 57/0006 | 473/387 |
| 2007/0149300 | A1 | 6/2007 | McNamara | | |
| 2008/0064533 | A1 | 3/2008 | Norman | | |
| 2009/0054169 | A1 | 2/2009 | Rodriguez | | |
| 2009/0191983 | A1 | 7/2009 | Otsubo | | |
| 2010/0267492 | A1 | 10/2010 | McCracken | | |
| 2011/0230273 | A1 | 9/2011 | Niegowski et al. | | |
| 2012/0264546 | A1 | 10/2012 | Daniel et al. | | |
| 2013/0090186 | A1 | 4/2013 | Edison | | |
| 2014/0057741 | A1 | 2/2014 | Blazure | | |
| 2018/0008874 | A1 * | 1/2018 | Hewit | A63B 57/20 | |

FOREIGN PATENT DOCUMENTS

| | | | | |
|---|---|---|---|---|
| KR | 2006094445 A * | 8/2006 | A63B 57/10 | |
| KR | 1964010 B1 * | 4/2019 | A63B 57/10 | |
| WO | WO-02087702 A2 * | 11/2002 | A63B 69/0075 | |

OTHER PUBLICATIONS

"How to Play Golf Game One Club," Golf.About.com, retrieved Jun. 28, 2016. http://golf.about.com/cs/golfterms/g/bldef_oneclub.htm.

"Team One Ball Format," National Team Golf Association (NTGA), retrieved Jul. 9, 2015. http://www.ntgatour.com/team-one-ball-format/.

Fornoff, Susan, "A fun golf tournament format for everyone", retrieved Jul. 14, 2016, <http://www.gottagogolf.com/blog/susanfornoff/a-fun-golf-tournament-format-for-everyone>.

Hill, Brian, "Fun Games to Play in a Scramble Golf Tournament", Jan. 23, 2013, retrieved Jul. 14, 2016, <https://golftips.golfsmith.com/fun-games-play-scramble-golf-tournament-20036.html>.

* cited by examiner

METHOD AND APPARATUS FOR PLAYING TEAM GOLF

CROSS REFERENCE TO RELATED APPLICATIONS

This application is a continuation-in-part of U.S. patent application Ser. No. 14/659,868 filed on Mar. 17, 2015 entitled METHOD AND APPARATUS FOR PLAYING TEAM GOLF, which claims priority from U.S. Provisional Patent Application No. 61/967,725 filed on Mar. 25, 2014, both of which applications are hereby incorporated by reference.

BACKGROUND

The present application relates to a method of playing golf, more particularly to an improved method and associated apparatus that enables a collaborative effort among a group of golfers using one ball per team.

The popularity of golf has been steadily declining. The golf industry has lost 5 million golf participants over the last 20 years. The number of golfers in the 18 to 34 age category has dipped 30 percent in the last 10 years. Golf's decline is predicted to continue because the game is expensive, time-consuming and difficult to learn. Golfers play golf using a set of clubs (typically 14 clubs). Because they include so many clubs, golf club sets are expensive and can be difficult to carry and manage. The golf industry has tried several initiatives to attract golfers and make golf easier to learn and play such as Golf 2.0, Golf 20/20, Tee it Forward, and increasing the size of the cup on the green. However, these efforts have had limited success.

Accordingly, it is desired to provide an improved method and apparatus for playing team golf.

It is also desired to provide an improved method and associated apparatus for playing team golf aimed at increasing the number of new golf participants and increasing the enjoyment of playing the game.

It is also desired to provide an improved method and associated apparatus for playing team golf in which the expenses of golf are substantially decreased while enhancing the enjoyment of playing golf.

BRIEF SUMMARY OF THE DISCLOSURE

In accordance with one or more embodiments, a method is disclosed for collaboratively playing golf in an optional selective shot format by a group of golf players on a golf course using a novel golf tee, a single set of golf clubs, and a single golf ball. The golf course comprises a plurality of holes, each hole having at least a tee box and a putting green with a cup. The method includes the steps of: (a) assigning one or more golf clubs in said single set of golf clubs to be carried and used by each of said group of golf players; and (b) at each of said plurality of holes: (i) striking, by one and only one player of said group of golf players, the single golf ball at the tee box for the hole using only the one or more golf clubs assigned to that player; (ii) determining which one and only one of said group of golf players will hit the next shot of the single golf ball where it has landed to advance the single golf ball toward the cup for the hole; (iii) striking, by the one and only one player determined in (ii), the single golf ball using only the one or more golf clubs assigned to that player; and (iv) repeating steps (ii) and (iii) until the single golf ball is in the cup. At least one of the steps of striking the single golf ball during a round is preceded by positioning the golf ball on the golf tee. The golf tee comprises a stem insertable into the ground connected to a head for supporting a golf ball. The head is configured to surround and support a portion of the golf ball, including the portion of the ball facing the golf player. The head comprises a back portion configured to be impacted by the golf club and two side portions extending from the back portion and wrapping around opposite sides of the golf ball to surround up to 180° of the circumference of the golf ball to inhibit side spin of the golf ball upon impact by the golf club.

In accordance with one or more further embodiments, a novel golf tee is disclosed comprising a stem positionable on the ground and a head connected to the stem for supporting a golf ball. The head is configured to surround and support a portion of the golf ball, including the portion of the ball facing a golf player when positioned to hit the golf ball. The head comprises a back portion configured to be impacted by a golf club of the golf player and two side portions extending from the back portion and wrapping around opposite sides of the golf ball to surround up to 180° of the circumference of the golf ball to inhibit side spin of the golf ball upon impact by the golf club.

To accomplish the foregoing and other objects, features and advantage of the present invention there is provided a golf game apparatus that is played by a team or at least two separate teams that compete for lowest score. Each team includes multiple players that each have a playing venue that progresses along a golf course as the golf game is played, the playing venue being unique to each respective player including the players playing space and at which an event occurs of engaging a golf ball. Each team has only one set of clubs that include at least one driver, at least one putter and multiple irons or woods, the set of clubs being sufficiently complete in order to enable the players of a team to collectively play a round of golf progressively at successive holes of the golf course. Each respective player venue includes one or more of the clubs of the set of clubs, all of the clubs of the set of clubs of a team being allocated to the respective multiple players of a team with each team player playing only their allocated club or clubs until the team finishes the hole.

In accordance with other aspects of the present invention including at least first and second respective players each having some, but less than all, of the clubs of the set at their respective playing venue; the number of players of a team is equal to or less than the number of clubs used in a set; the number of players of a team can be equal to the number of clubs used in a set so that each and every player of a team possesses only one club to be used; for example, there are seven players and an associated seven clubs; the clubs include a driver, fairway wood, #5 iron, #7 iron, #9 iron, sand wedge and putter; the players have respective one through seven playing venues; only one ball is used by all players of a team and hit successively by players one through seven by the player who can hit the appropriate shot from that distance and situation; wherein, at the beginning of any hole the club or clubs in a player's venue is swapped with another player of the same team; one of the players on a team is determined to be a team captain; the team captain is typically the player with the lowest handicap; at least some of the players that may carry only a single club will not require any carry bag; the players of a team include greater than two players each having a playing venue; and each playing venue includes the corresponding player and the player's club.

DETAILED DESCRIPTION

Various embodiments disclosed herein are directed to a method of playing team golf, which provides a friendlier, more fun, and less expensive way to play and learn golf. The team golf method is a collaborative effort among a team of golfers using a novel golf tee, one golf ball, and one golf club (or only a few golf clubs) per team member with an optional selective shot format. The method of playing team golf will increase the number of new golf participants and provide a comfortable environment for average golfers and non-golfers to learn, enjoy, and more frequently play golf.

The method of playing team golf in accordance with one or more embodiments is as follows: two teams play against each other on each hole. Alternatively, more than two teams can compete against each other on each hole, or one team can play against par for the course. Each team is made up of at least two players, preferably 4-7 players. In a most preferred embodiment, particularly where it is preferred not to have to carry a golf bag, only one club is assigned to each player. Alternatively, each of the players on a team may be assigned a subset of the clubs in a golf set. For instance, each player can be assigned one to three clubs to use during the round. For instance, if a team has 7 players each play be assigned a different one of the following golf clubs: driver, fairway wood, #5 iron, #7 iron, #9 iron, sand wedge, and putter. Each team will only use one ball and play with an optional selective shot format. Each team can have a captain, who can, e.g., be the player with the lowest handicap in the team. The novel golf tee (examples of which are illustrated in FIGS. 4, 5A-5D, and 6A-6D) must be used at least once by a team during a round in accordance with one or more embodiments. In one or more preferred embodiments, each team must use the novel golf tee at least once on each hole during the round. In accordance with one or more further preferred embodiments, each team must use the novel golf tee on all golf shots hit from a tee box or a fairway.

Figure 1:
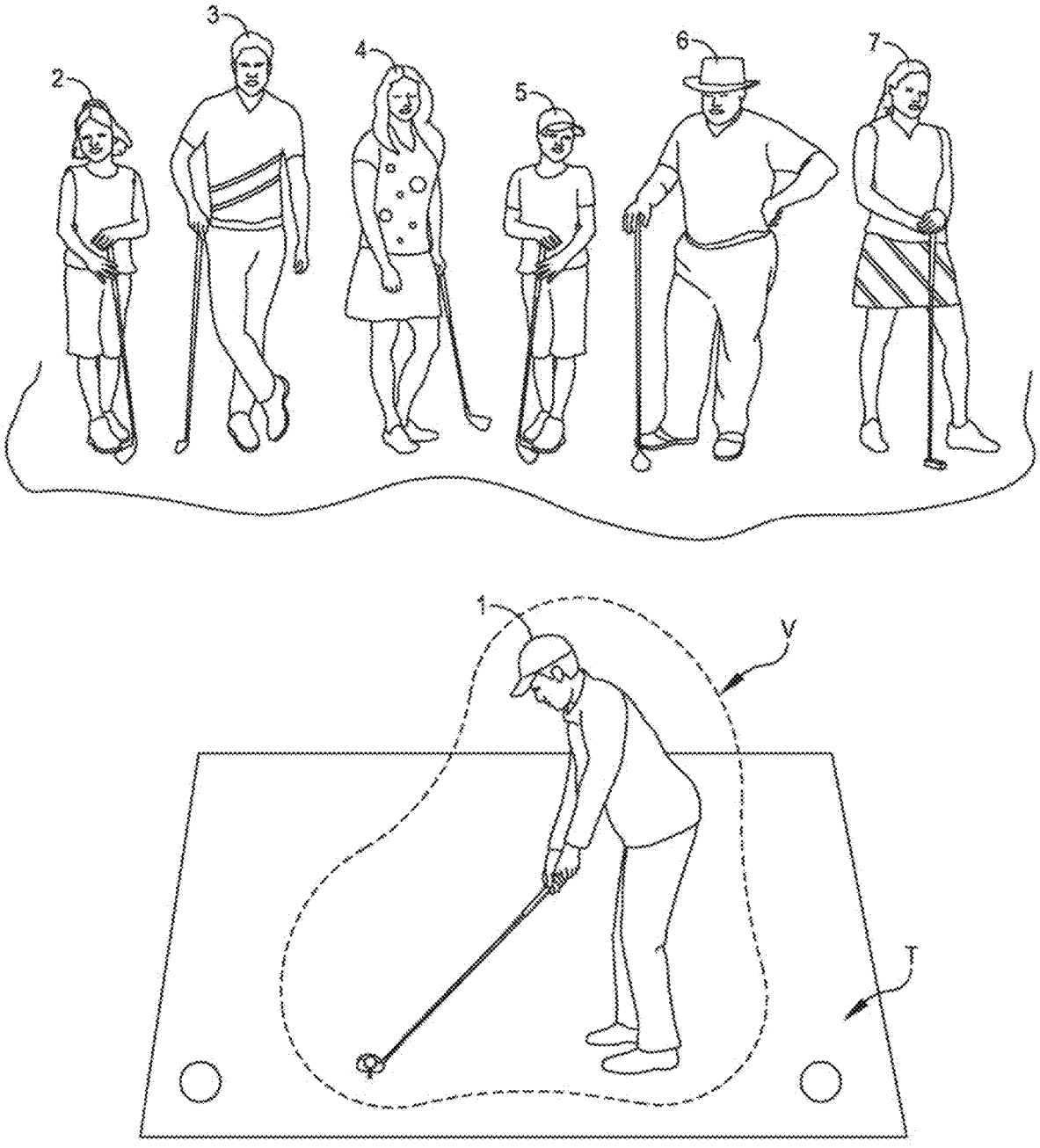
FIG. 1 illustrates a team of seven golfers with a player assigned to the driver ready to tee off in a method for playing team golf in accordance with one or more embodiments.

Play at each hole starts with one of the players on each team hitting off the tee. FIG. 1 shows the player with the driver teeing off. The team will determine who the best person for the next shot is once the team reaches the ball. The process will continue for each team until the ball is hit into the cup.

A player may hit the ball more than once per hole if needed. For example, the best way to approach a short Par 4 hole could be to tee off with a #5 iron and then hit another #5 iron into the green. In this case the player assigned the #5 iron club would hit twice on this hole.

However, only one person can hit at a time and from that position. Every player's shot will count towards the team score. This is in contrast to a scramble or other methods and formats, in which multiple players hit their own ball from the same position and only choose one ball. The rest of the three balls are then picked up and will not be included in the team score.

No golf bags are necessary, because each team member carries only one club or very few clubs. A large number of golfers can play at a time. For instance, 14 different golfers can play on the same hole with two teams of seven players.

Focusing on one club with a team with an optional selective shot format will allow players to more easily learn the game and improve their skills. The format will lead to quicker play because there is no need for players to select from 14 different clubs. It also does not require individual players to buy expensive sets of 14 clubs. The format will especially encourage beginners, women and juniors to play together with friends as well as all levels of golfers, yet still in a traditional way. The golf format will also be more affordable with greens fees expected to be around $9 per 18 holes, compared to the current approximate average of $30.

Friends, co-workers, family and relatives can play together while having fun and getting exercise and enjoying the scenery of a golf course. Eventually, the team golf method and apparatus will convert more players to traditional individual golf.

Thus, in accordance with the format of the present invention every member of the team has an opportunity to practice preferably with a single club and also preferably with only one shot at a time. This will tend to make that player skillful with that particular club.

In an alternate embodiment of the present invention, at the beginning of any particular hole, clubs of a player may be swapped with another player. In this way, during the playing of the course, players can get accustomed to using different clubs while all players of the team are still devoted to attaining the lowest playing score.

In accordance with the present invention there is provided a golf game apparatus that is played by a team or at least two separate teams that compete for the lowest score. Each team includes multiple players such as the players 1-7 illustrated in FIGS. 1-3. Each of the players is considered as having a playing venue. See in FIGS. 1-3 the venue V. This playing venue may be considered as essentially progressing along a golf course as the golf game is played. The playing venue V is unique to each respective player includes the players' playing space and at which an event occurs of engaging a golf ball such as shown in any one of FIGS. 1-3.

Figure 2:
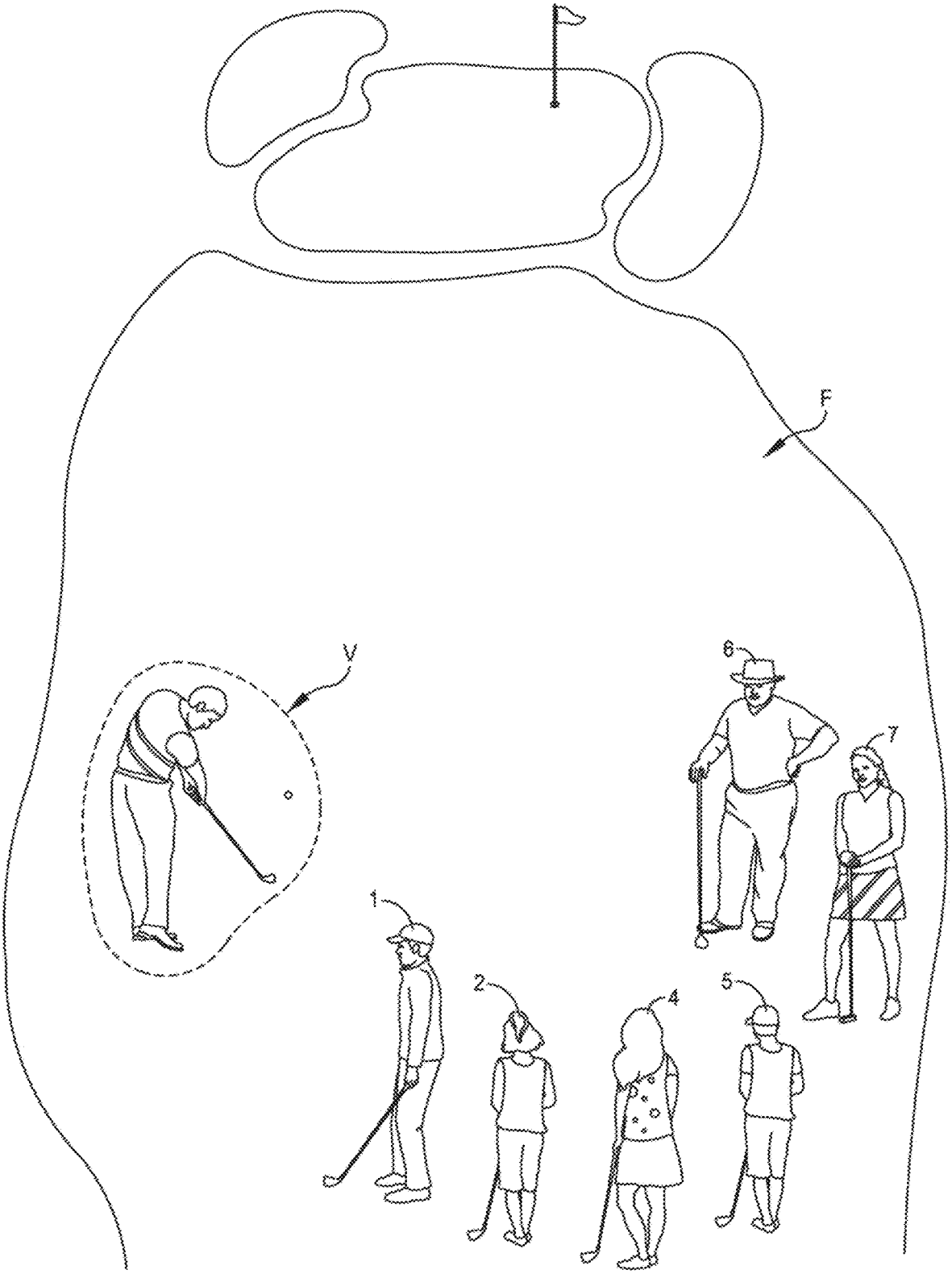
FIG. 2 illustrates the team on a fairway with the player assigned to the #5 iron hitting the ball in a method for playing team golf in accordance with one or more embodiments.
Figure 3:
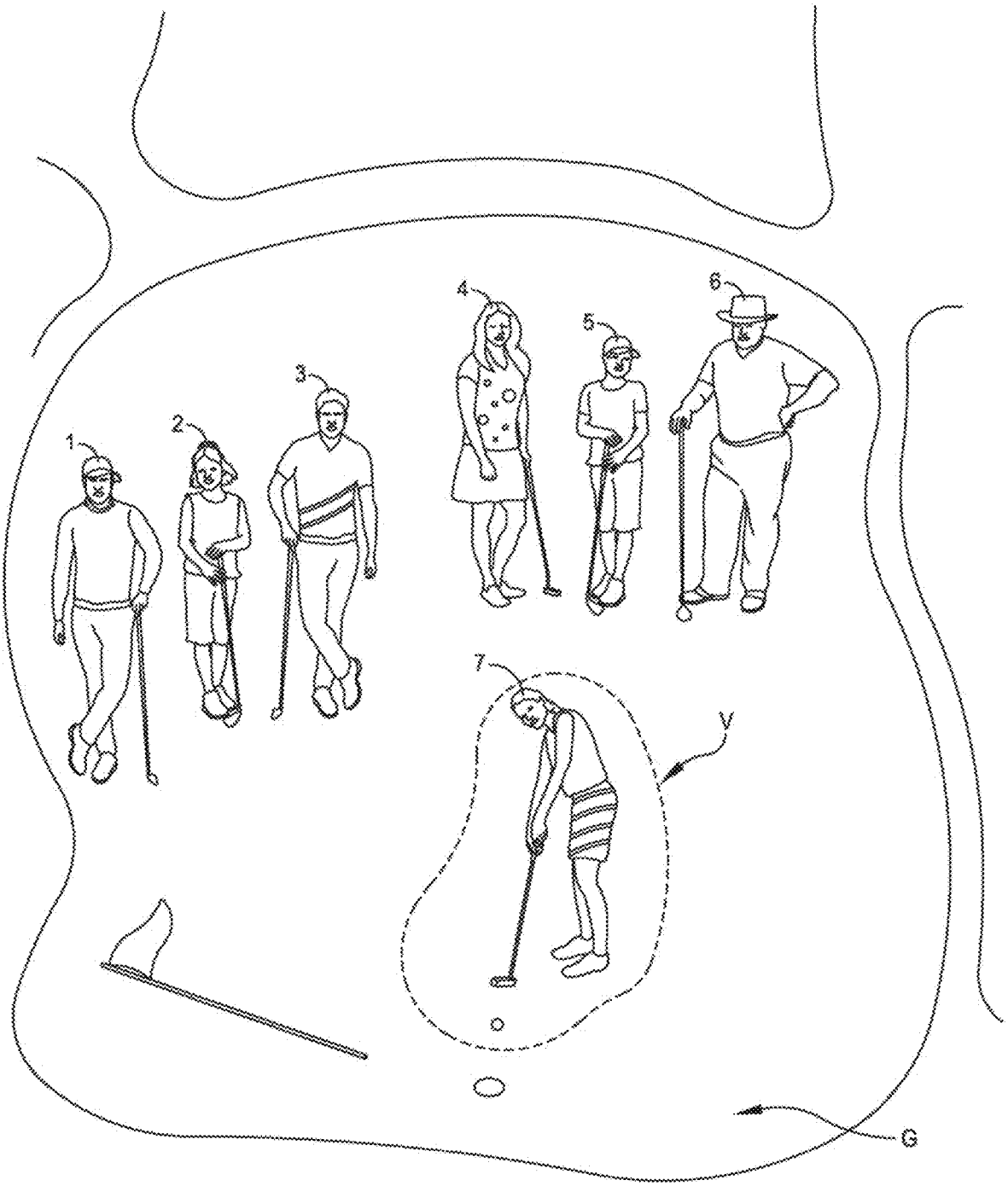
FIG. 3 illustrates the team on the green with the player assigned to the putter putting on the ball in a method for playing team golf in accordance with one or more embodiments.
Figure 4:
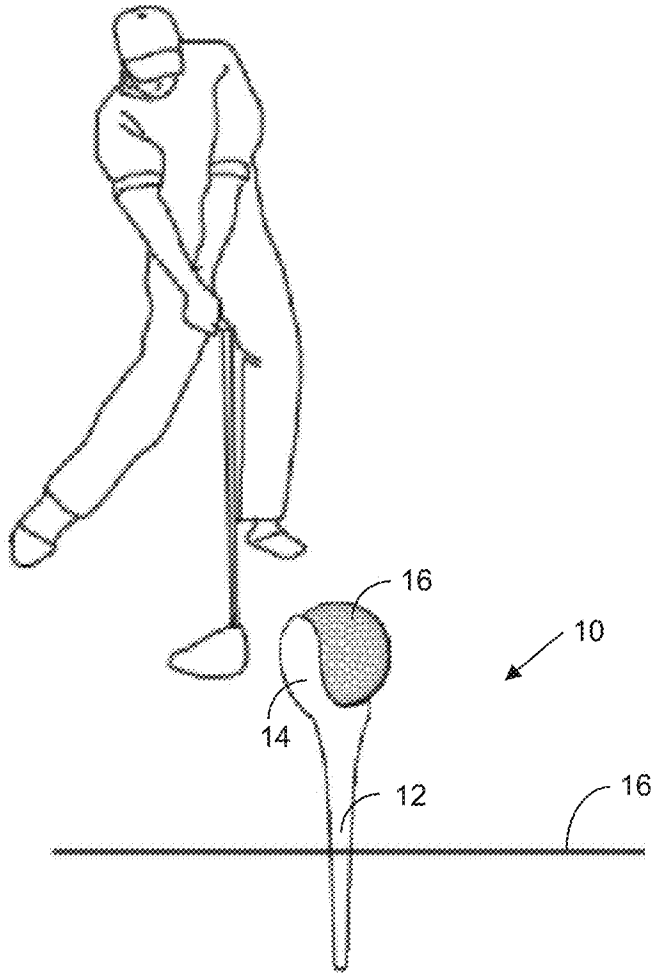
FIG. 4 illustrates an exemplary golf tee usable in playing team golf in accordance with one or more embodiments. (The golfer in this figure is shown for illustrative purposes and is not to scale.)
Figures 5A, 5B, 5C, 5D:
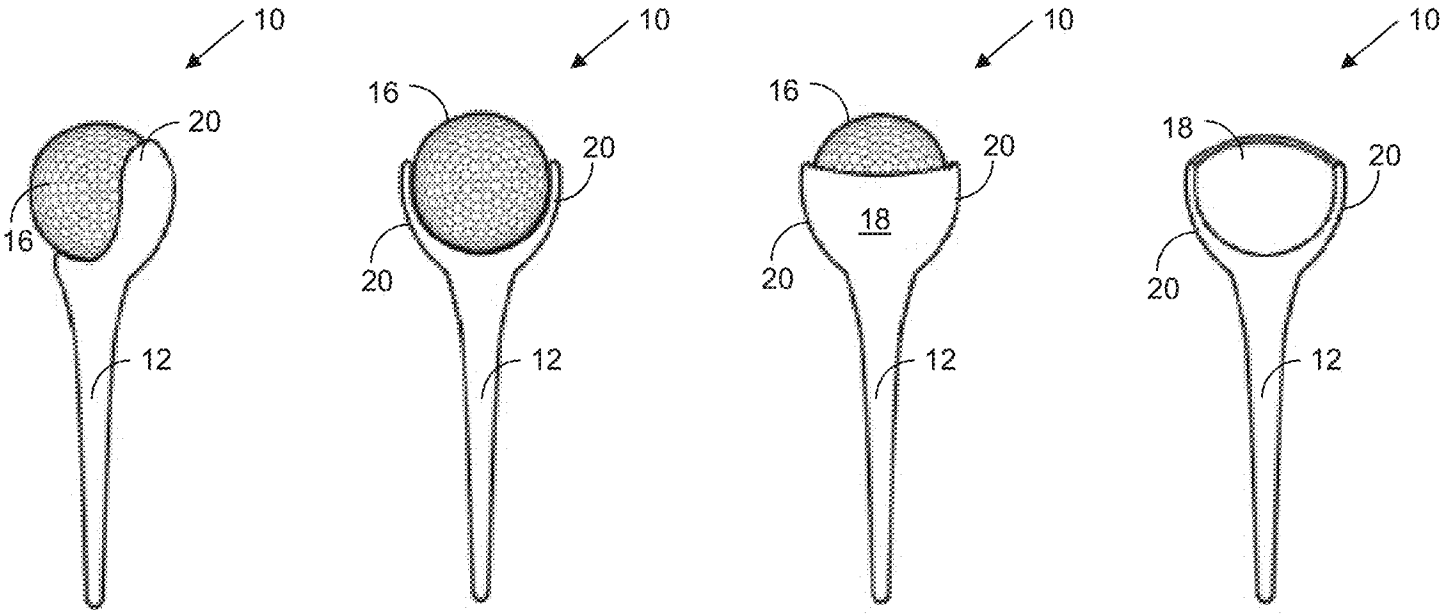
FIGS. 5A-5D illustrate various views of the golf tee of FIG. 4.

Each team has only one set of clubs that will typically include at least one driver, at least one putter and multiple irons or woods. The set of clubs is sufficiently complete in order to enable the players of a team to collectively play a round of golf progressively at successive holes of the golf course. Each respective player venue includes one or more of the clubs of the set of clubs. All of the clubs of the set of clubs of a team are allocated to the respective players of a team with each team player playing only their allocated club or clubs until the team finishes the hole. This is clearly illustrated in the drawings wherein each player is shown as including only a single club. In FIG. 1 the number one player is shown teeing off at the course T area. In FIG. 2 player number three is shown at its venue at the fairway F location of the golf course. Finally, in FIG. 3 the player seven is shown at its venue about to engage the golf ball B at the putting green G.

FIGS. 4 and 5A-5D show an exemplary novel golf tee 10 for use in playing team golf in accordance with one or more embodiments. The golf tee 10 comprises an elongate stem 12 (with a pointed tip to ease insertion into the ground 16) and a head 14 for supporting a golf ball 16. The head 14 of the golf tee 10, which is shown in further detail in FIGS. 5A-5D, is a cup-like structure configured to surround and support a substantial portion of the golf ball 16, including the portion of the ball facing the golfer intended to be struck by a golf club. The head 14 comprises a back portion 18 configured to be impacted by the golf club and two side portions 20 extending from the back portion 18 and wrapping around the sides of the golf ball 16. The head 14 surrounds a portion of the golf ball 16 up to 180° of the circumference of the ball 16. The head 14 surrounds the golf ball 16 preferably between 130° to 180°, more preferably between 140° to 180°, more preferably between 150° to 180°, more preferably between 160° to 180°, and even more preferably between 170° to 180° of the circumference of the ball 16.

In use, the golf tee 10 inhibits golf club from directly striking the golf ball 16. Instead, the golf club strikes the back portion 18 of the head 14, which supports the ball 16. Because the head 14 substantially surrounds the portion of the ball 16 to which the golf club is directed, any misalignment of the golf club relative to the ball 16 at impact will not impart substantial side spin of the ball, which can result in slicing of the ball out of bounds. The novel golf tee 10 thereby makes it substantially easier to properly hit golf balls, making it particularly suited for use in team golf, which can be played by inexperienced golfers.

Figures 6A, 6B, 6C, 6D:
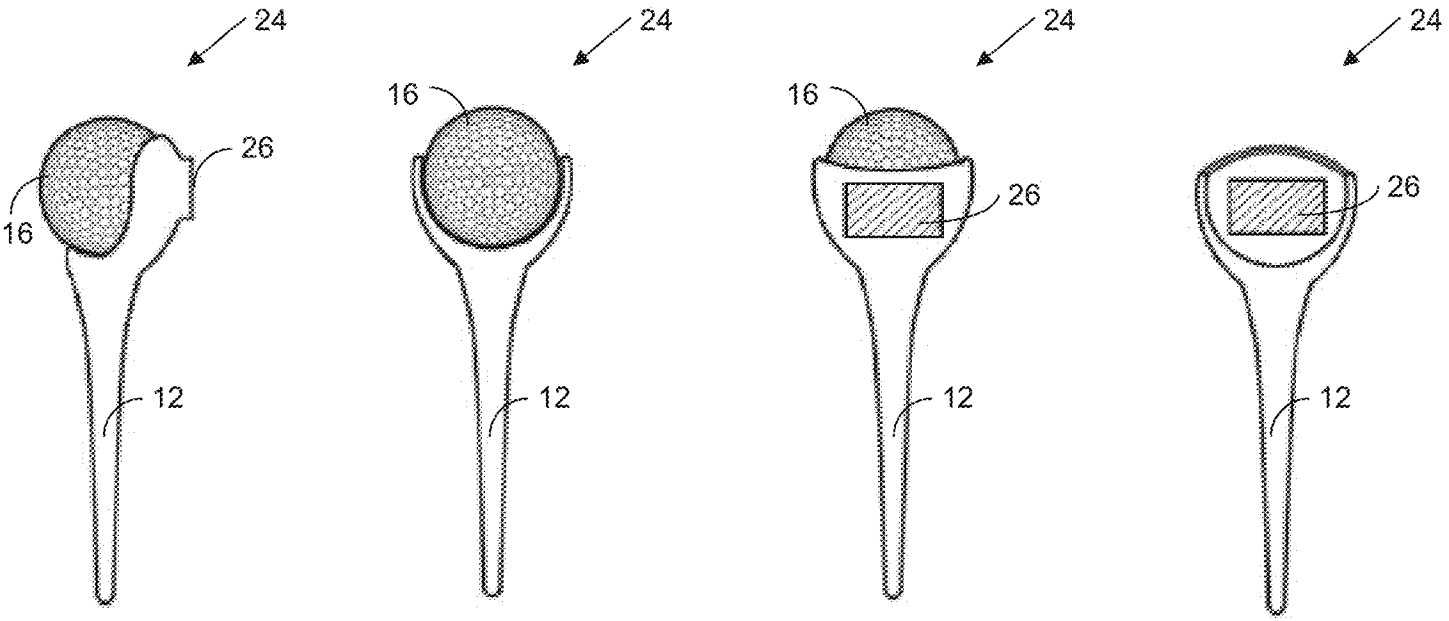
FIGS. 6A-6D illustrate various views of an alternative exemplary golf tee usable in playing team golf in accordance with one or more embodiments.
Figures 7A, 7B, 7C, 7D:
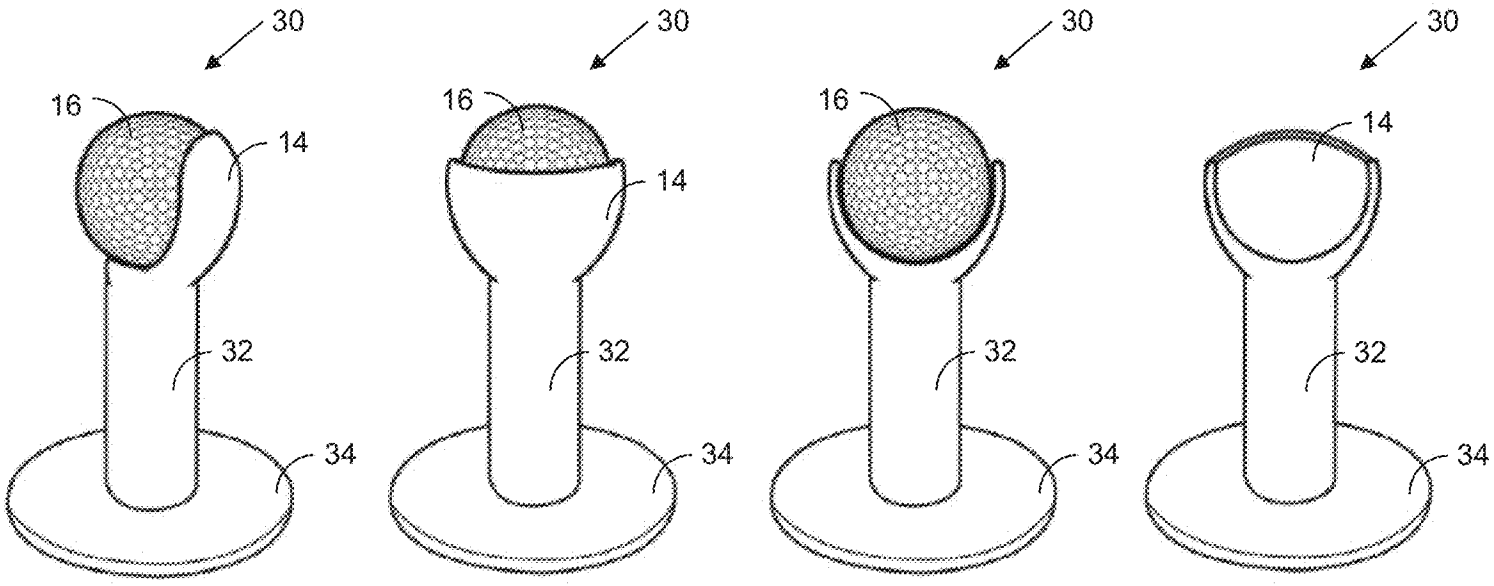
FIGS. 7A-7D illustrate various views of an exemplary golf tee usable for practice in a range mat in accordance with one or more embodiments.
Figures 8A, 8B, 8C, 8D:
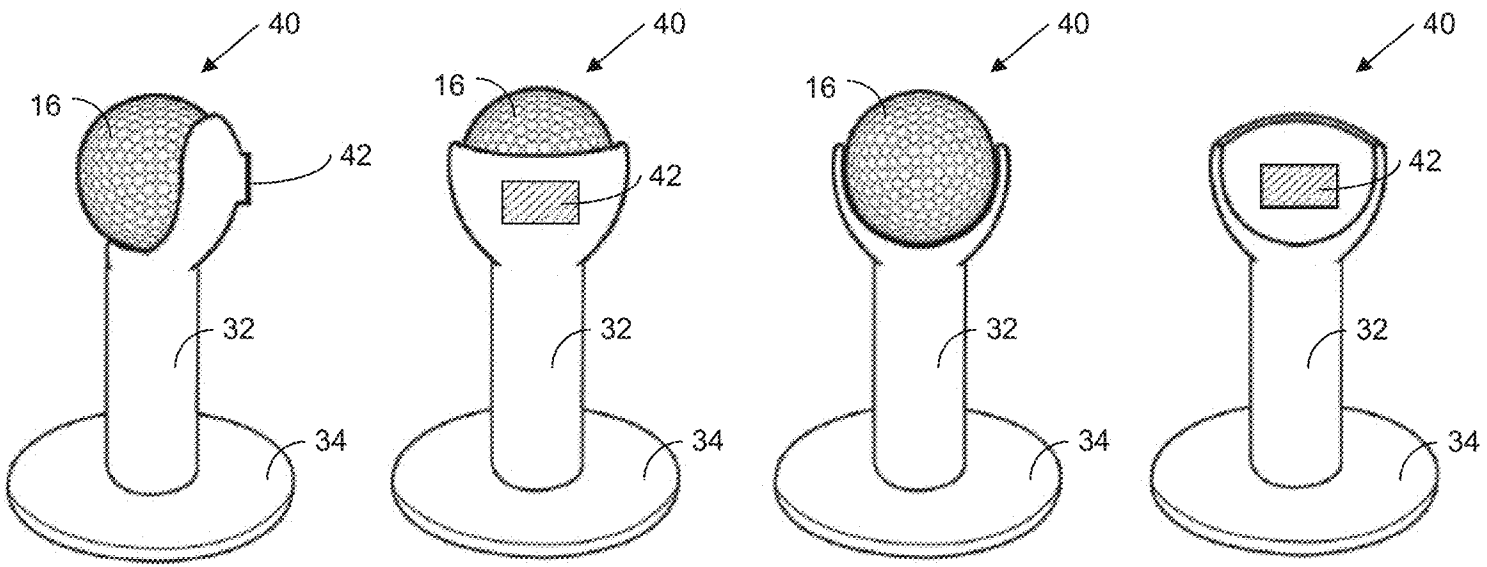
FIGS. 8A-8D illustrate various views of an alternative exemplary golf tee usable for practice in a range mat in accordance with one or more embodiments.

FIGS. 6A-6B illustrate an exemplary alternative golf tee 24, which is similar in structure to the golf tee 10, but includes a flat surface 26 at the back portion of the head 14 of the tee. The flat surface 26 is configured to be impacted by the golf club, and is intended to provide a visual cue to help golfers properly align the face of the golf club at impact with the ball during the golf swing.

FIGS. 7A-7D illustrate an exemplary golf tee 30 usable for practice in a driving range in a range mat in accordance with one or more embodiments. The golf tee 30 is similar in structure to the golf tee 10, but includes an enlarged stem 32 and base 34 adapted to be held in a driving range mat.

FIGS. 8A-8D illustrate another exemplary golf tee 40 usable for practice in a driving range in a range mat in accordance with one or more embodiments. The golf tee 40 is similar in structure to the golf tee 30, but includes but includes a flat surface 42 at the back portion of the head of the tee designed to be struck by a golf club.

The golf tees described above can be constructed from a variety of materials including, but not limited to, plastics, rubber, wood, and other materials or combinations thereof.

Having thus described several illustrative embodiments, it is to be appreciated that various alterations, modifications, and improvements will readily occur to those skilled in the art. Such alterations, modifications, and improvements are intended to form a part of this disclosure, and are intended to be within the spirit and scope of this disclosure. While some examples presented herein involve specific combinations of functions or structural elements, it should be understood that those functions and elements may be combined in other ways according to the present disclosure to accomplish the same or different objectives. In particular, acts, elements, and features discussed in connection with one embodiment are not intended to be excluded from similar or other roles in other embodiments. Accordingly, the foregoing description and attached drawings are by way of example only, and are not intended to be limiting.

What is claimed is:

1. A method of collaboratively playing golf in an optional selective shot format by a group of golf players on a golf course using a novel golf tee, a single set of golf clubs, and a single golf ball, the golf course comprising a plurality of holes, each hole having at least a tee box and a putting green with a cup, the method comprising the steps of:

(a) assigning one or more golf clubs in said single set of golf clubs to be carried and used by each of said group of golf players; and (b) at each of said plurality of holes:

(i) striking, by one and only one player of said group of golf players, the single golf ball at the tee box for the hole using only the one or more golf clubs assigned to that player;

(ii) determining which one and only one of said group of golf players will hit the next shot of the single golf ball where it has landed to advance the single golf ball toward the cup for the hole;

(iii) striking, by the one and only one player determined in (ii), the single golf ball using only the one or more golf clubs assigned to that player; and (iv) repeating steps (ii) and (iii) until the single golf ball is in the cup, wherein at least one of said steps of striking the single golf ball during a round is preceded by positioning the golf ball on the golf tee, wherein the golf tee comprises a stem inserted into the ground connected to a head for supporting a golf ball, wherein the head is configured to surround and support a portion of the golf ball, including the portion of the ball facing the golf player, wherein the head comprises a back portion configured to be impacted by the golf club and two side portions extending from the back portion and wrapping around opposite sides of the golf ball to surround up to 180° of the circumference of the golf ball to inhibit side spin of the golf ball upon impact by the golf club, wherein the back portion of the head of the golf tee includes a flat planar element extending substantially across the back portion and configured to provide a visual cue to guide the golf player to square the face of the golf club at impact when striking the golf ball.

2. The method of claim 1, wherein the head of the golf tee is configured to surround a portion of the golf ball between 130° to 180° of the circumference of the golf ball.

3. The method of claim 1, wherein at least one of said steps of striking the single golf ball during each hole is preceded by positioning the golf ball on the golf tee.

4. The method of claim 1, wherein all of said steps of striking the single golf ball except when the golf ball is on the putting green are preceded by positioning the golf ball on the golf tee.

5. The method of claim 1, wherein the single set of golf clubs comprises a driver, one or more fairway woods, one or more irons, and a putter.

6. The method of claim 1, wherein the single set of golf clubs comprises a driver, a fairway wood, a #5 iron, a #7 iron, a #9 iron, a sand wedge, and a putter.

7. The method of claim 1, wherein each of said golf players is assigned a single club from said single set of golf clubs.

8. The method of claim 1, further comprising changing the one or more golf clubs assigned to each of said golf players after at least one hole.

9. The method of claim 1, further comprising performing steps (a) and (b) by an additional different second group of golf players playing against said group of golf players using another single set of golf clubs and another single ball at each hole.

10. The method of claim 1, wherein the group of golf players plays alone against par on each hole.

11. The method of claim 1, wherein the number of players in said group of golf players is equal to the number of golf clubs in the single set of golf clubs.

12. The method of claim 1, wherein the group of golf players includes a team captain, wherein step (b)(ii) is performed by the team captain.

13. The method of claim 1, wherein the group of golf players includes a team captain, wherein step (a) is performed by the team captain.

14. The method of claim 1, wherein the group of golf players includes a team captain, said team captain having the lowest handicap in said group of golf players.

* * * * *